US006660464B1

(12) United States Patent
Muenter et al.

(10) Patent No.: US 6,660,464 B1
(45) Date of Patent: Dec. 9, 2003

(54) PHOTOGRAPHIC ELEMENT CONTAINING A FRAGMENTABLE ELECTRON DONOR FOR IMPROVED PHOTOGRAPHIC RESPONSE

(75) Inventors: Annabel A. Muenter, Rochester, NY (US); Steven P. Szatynski, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 38 days.

(21) Appl. No.: 09/596,464

(22) Filed: Jun. 19, 2000

(51) Int. Cl.[7] ..... G03C 1/76

(52) U.S. Cl. ..... 430/533; 430/523; 430/536; 430/538; 430/583; 430/599; 430/600; 430/603

(58) Field of Search ..... 430/536, 538, 430/583, 599, 600, 603, 533, 523

(56) References Cited

U.S. PATENT DOCUMENTS

| | | | | | |
|---|---|---|---|---|---|
| 5,084,334 | A | * | 1/1992 | Hamano et al. | 428/304.4 |
| 5,168,033 | A | * | 12/1992 | Takada et al. | 430/533 |
| 5,747,235 | A | * | 5/1998 | Farid et al. | 430/583 |
| 5,747,236 | A | * | 5/1998 | Farid et al. | 430/583 |
| 5,994,051 | A | | 11/1999 | Gould et al. | |
| 6,010,841 | A | * | 1/2000 | Farid et al. | 430/583 |
| 6,027,869 | A | * | 2/2000 | Maskasky et al. | 430/567 |
| 6,054,260 | A | | 4/2000 | Adin et al. | |
| 6,114,102 | A | * | 9/2000 | Aylward et al. | 430/536 |
| 6,132,951 | A | * | 10/2000 | Ezure et al. | 430/627 |

FOREIGN PATENT DOCUMENTS

| | | |
|---|---|---|
| EP | 0 530 668 A1 | 3/1993 |
| EP | 0 893 732 | 1/1999 |

OTHER PUBLICATIONS

*Research Disclosure*, vol. 389, Sep. 1996, Item 38957, IV.

* cited by examiner

*Primary Examiner*—Janet Baxter
*Assistant Examiner*—Amanda C. Walke
(74) *Attorney, Agent, or Firm*—Edith A. Rice; Sarah Meeks Roberts

(57) ABSTRACT

This invention comprises a silver halide photographic element comprising a support with low oxygen permeability and at least one silver halide emulsion layer containing a fragmentable electron donating compound of the formula: X—Y' or a compound which contains a moiety of the formula —X—Y'; wherein X is an electron donor moiety, Y' is a leaving proton H or a leaving group Y, with the proviso that if Y' is a proton, a base, $\beta^-$, is present in the emulsion layer, and wherein:

1) X—Y' has an oxidation potential between 0 and about 1.4 V; and 2) the oxidized form of X—Y' undergoes a bond cleavage reaction to give the radical $X^{\bullet}$ and the leaving fragment Y';

and, optionally, 3) the radical $X^{\bullet}$ has an oxidation potential$\leqq$−0.7V (that is, equal to or more negative than about −0.7V).

20 Claims, No Drawings

PHOTOGRAPHIC ELEMENT CONTAINING A FRAGMENTABLE ELECTRON DONOR FOR IMPROVED PHOTOGRAPHIC RESPONSE

FIELD OF THE INVENTION

This invention relates to a photographic element having improved photographic response.

BACKGROUND OF THE INVENTION

It is a long-standing objective of photographic origination materials to maximize the overall response to light while maintaining the lowest possible granularity. Increased photographic sensitivity to light (commonly referred to as photographic speed) allows for improved images captured under low light conditions or improved details in the shadowed regions of the image. In general, the overall light sensitivity provided by the light sensitive silver halide emulsions in such systems is determined by the size of the emulsion grains. Larger grains capture more light. Upon development of black and white photographic elements, the captured light is ultimately converted into silver deposits which constitute the reproduced image. For color photographic elements, development leads to a reproduced image provided by dye deposits. However, the granularity expressed by the silver or dye deposits is directly proportional to the grain size of the silver halide emulsion. Thus, larger silver halide emulsion grains have higher sensitivity to light but also lead to higher granularity in the reproduced image. It has been a long-standing problem to provide materials which maximize the response to light of a silver halide emulsion for any given grain size.

Chemical sensitizing agents have been used to enhance the intrinsic sensitivity of silver halide. Conventional chemical sensitizing agents include various sulfur, gold, and group VIII metal compounds. A summary of chemical sensitizers is provided by *Research Disclosure*, Vol. 389, September 1996, Item 38957, IV. Chemical sensitization.

Spectral sensitizing agents, such as cyanine and other polymethine dyes, have been used alone, or in combination, to impart spectral sensitivity to emulsions in specific wavelength regions. These sensitizing dyes function by absorbing long wavelength light that is essentially unabsorbed by the silver halide emulsion and using the energy of that light to cause latent image formation in the silver halide. A summary of spectral sensitizing dyes is provided by *Research Disclosure*, Item 38957, cited above, V. Spectral sensitization and desensitization, A. Sensitizing Dyes.

It has been recently recognized that a further enhancement in photographic speed can be realized by associating with the silver halide grain surfaces a fragmentable electron donating (FED) sensitizer. Fragmentable electron donors are compounds that have been designed to undergo a bond fragmentation reaction after capturing the photohole created by absorption of light in a silver halide emulsion. This fragmentation reaction removes the photohole from the emulsion, thus reducing the probability of recombination with the photoelectron and giving improved light sensitivity. For some compounds, termed fragmentable two electron donors, the radical resulting from the bond fragmentation reaction is designed to be sufficiently energetic so as to inject an electron into the silver halide emulsion. Consequently, absorption of one photon by a silver halide emulsion containing a fragmentable two electron donor results in creation of two electrons in the silver halide emulsion, the first resulting from the initial absorption of the photon and the second resulting from the sequence of reactions caused by capture of the photohole at the fragmentable two electron donor. The production of this second electron leads to increased photographic speed. Fragmentable electron donors have been described in U.S. Pat. Nos. 5,747,235, 5,747,236, 5,994,051, 6,010,841, and 6,054,260 and published European Patent Application 893,732. These references disclose speed gains associated with the use of fragmentable electron donors in a wide variety of silver halide emulsions. However, it is also frequently found that addition of a fragmentable electron donor to an emulsion increases the storage fog, particularly for storage temperatures above room temperature. making it necessary to limit the amount of fragmentable electron donor used in order to avoid excessive storage fog. In such cases, the extent of practical speed gain obtainable from the fragmentable electron donor may be reduced.

Consequently, it is of interest to find means to reduce the storage fog associated with the presence of fragmentable electron donors in a photographic element.

SUMMARY OF THE INVENTION

We have discovered that coating the photographic layer(s) containing the fragmentable electron donor on a support with low oxygen permeability, such as a polyester support, substantially decreases the high temperature storage fog as compared to the same layer formulation coated on a support with high oxygen permeability, such as cellulose acetate support.

This invention provides a silver halide photographic element comprising a support with low oxygen permeability and at least one silver halide emulsion layer containing a fragmentable electron donating compound of the formula: X—Y' or a compound which contains a moiety of the formula —X—Y'; wherein X is an electron donor moiety, Y' is a leaving proton H or a leaving group Y, with the proviso that if Y' is a proton, a base, $\beta^-$, is present in the emulsion layer, and wherein:

1) X—Y' has an oxidation potential between 0 and about 1.4 V; and
2) the oxidized form of X—Y' undergoes a bond cleavage reaction to give the radical $X^{\bullet}$ and the leaving fragment Y';

and, optionally, 3) the radical $X^{\bullet}$ has an oxidation potential $\leqq -0.7$V (that is, equal to or more negative than about −0.7V).

DETAILED DESCRIPTION OF THE INVENTION

In accordance with this invention the silver halide emulsion contains a fragmentable electron donating (FED) compound which enhances the sensitivity of the emulsion. The fragmentable electron donating compound is of the formula X—Y' or a compound which contains a moiety of the formula —X—Y'; wherein X is an electron donor moiety, Y' is a leaving proton H or a leaving group Y, with the proviso that if Y' is a proton, a base, $\beta^-$, is present in the emulsion layer, and wherein:

1) X—Y' has an oxidation potential between 0 and about 1.4 V; and
2) the oxidized form of X—Y' undergoes a bond cleavage reaction to give the radical $X^{\bullet}$ and the leaving fragment Y';

and, optionally, 3) the radical $X^{\bullet}$ has an oxidation potential $\leqq -0.7V$ (that is, equal to or more negative than about −0.7V).

Compounds wherein X—Y' meets criteria (1) and (2) but not (3) are capable of donating one electron and are referred to herein as fragmentable one-electron donating compounds. Compounds which meet all three criteria are capable of donating two electrons and are referred to herein as fragmentable two-electron donating compounds.

In this patent application, oxidation potentials are reported as "V" which represents "volts versus a saturated calomel reference electrode".

In embodiments of the invention in which Y' is Y, the following represents the reactions that are believed to take place when X—Y undergoes oxidation and fragmentation to produce a radical $X^{\bullet}$, which in a preferred embodiment undergoes further oxidation.

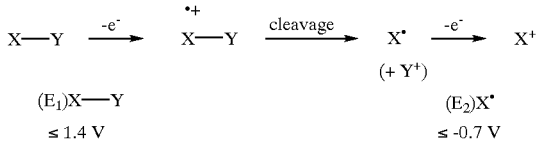

where $E_1$ is the oxidation potential of X—Y and $E_2$ is the oxidation potential of the radical $X^{\bullet}$.

$E_1$ is preferably no higher than about 1.4 V and preferably less than about 1.0 V. The oxidation potential is preferably greater than 0, more preferably greater than about 0.3 V. $E_1$ is preferably in the range of about 0 to about 1.4 V, and more preferably from about 0.3 V to about 1.0 V.

In certain embodiments of the invention the oxidation potential, $E_2$, of the radical $X^{\bullet}$ is equal to or more negative than −0.7V, preferably more negative than about −0.9 V. $E_2$ is preferably in the range of from about −0.7 to about −2 V, more preferably from about −0.8 to about −2 V and most preferably from about −0.9 to about −1.6 V.

The structural features of X—Y are defined by the characteristics of the two parts, namely the fragment X and the fragment Y. The structural features of the fragment X determine the oxidation potential of the X—Y molecule and that of the radical $X^{\bullet}$, whereas both the X and Y fragments affect the fragmentation rate of the oxidized molecule $X—Y^{\bullet+}$.

In embodiments of the invention in which Y' is H, the following represents the reactions believed to take place when the compound X—H undergoes oxidation and deprotonation to the base, $\beta^-$, to produce a radical $X^{\bullet}$, which in a preferred embodiment undergoes further oxidation.

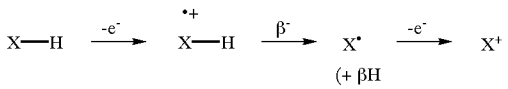

As mentioned above, the base $\beta^-$ is present in the emulsion. It is specifically contemplated that the base $\beta^-$ is in the emulsion by virtue of being covalently linked to X.

Preferred X groups are of the general formula:

(I)

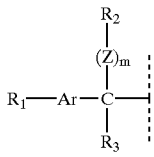

(II)

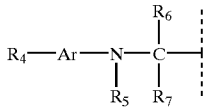

(III)

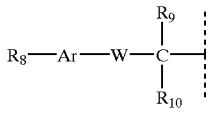

or (IV)

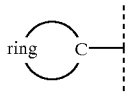

The symbol "R" (that is R without a subscript) is used in all structural formulae in this patent application to represent a hydrogen atom or an unsubstituted or substituted alkyl group.

In structure (I):

m=0, 1;

Z=O, S, Se, Te;

Ar=aryl group (e.g., phenyl, naphthyl, phenanthryl, anthryl); or heterocyclic group (e.g., pyridine, indole, benzimidazole, thiazole, benzothiazole, thiadiazole, etc.);

$R_1$=R, carboxyl, amide, sulfonamide, halogen, $NR_2$, $(OH)_n$, $(OR')_n$, or $(SR)_n$;

R'=alkyl or substituted alkyl;

n=1–3;

$R_2$=R, Ar';

$R_3$=R, Ar';

$R_2$ and $R_3$ together can form 5- to 8-membered ring;

$R_2$ and Ar=can be linked to form 5- to 8-membered ring;

$R_3$ and Ar=can be linked to form 5- to 8-membered ring;

Ar'=aryl group such as phenyl, substituted phenyl, or heterocyclic group (e.g., pyridine, benzothiazole, etc.)

R=a hydrogen atom or an unsubstituted or substituted alkyl group.

In structure (11):

Ar=aryl group (e.g., phenyl, naphthyl, phenanthryl); or heterocyclic group (e.g., pyridine, benzothiazole, etc.);

$R_4$=a substituent having a Hammett sigma value of −1 to +1, preferably −0.7 to +0.7, e.g., R, OR, SR, halogen, CHO, C(O)R, COOR, $CONR_2$, $SO_3R$, $SO_2NR_2$, $SO_2R$, SOR, C(S)R, etc;

$R_5$=R, Ar'

$R_6$ and $R_7$=R, Ar'

$R_5$ and Ar=can be linked to form 5- to 8-membered ring;

$R_6$ and Ar=can be linked to form 5- to 8-membered ring (in which case, $R_6$ can be a hetero atom);

$R_5$ and $R_6$ can be linked to form 5- to 8-membered ring;

$R_6$ and $R_7$ can be linked to form 5- to 8-membered ring;

Ar'=aryl group such as phenyl, substituted phenyl, heterocyclic group;

R=hydrogen atom or an unsubstituted or substituted alkyl group.

A discussion on Hammett sigma values can be found in C. Hansch and R. W. Taft *Chem. Rev.* Vol 91, (1991) p 165, the disclosure of which is incorporated herein by reference.

In structure (III):

W=O, S, Se;

Ar=aryl group (e.g., phenyl, naphthyl, phenanthryl, anthryl); or heterocyclic group (e.g., indole, benzimidazole, etc.)

$R_8$=R, carboxyl, $NR_2$, $(OR)_n$, or $(SR)_n$ (n=1–3);

$R_9$ and $R_{10}$=R, Ar';

$R_9$ and Ar=can be linked to form 5- to 8-membered ring;

Ar'=aryl group such as phenyl substituted phenyl or heterocyclic group;

R=a hydrogen atom or an unsubstituted or substituted alkyl group.

In structure (IV):

"ring" represents a substituted or unsubstituted 5-, 6- or 7-membered unsaturated ring, preferably a heterocyclic ring.

The following are illustrative examples of the group X of the general structure I:

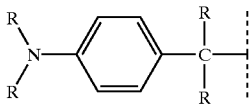

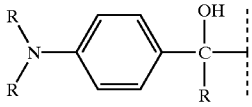

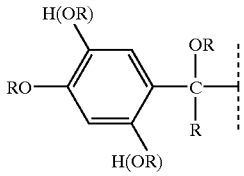

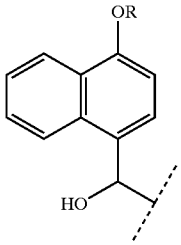

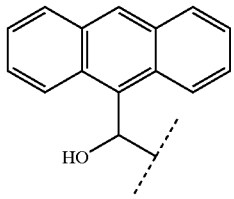

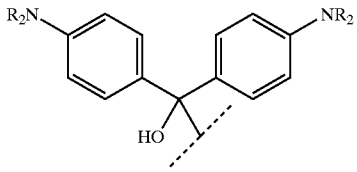

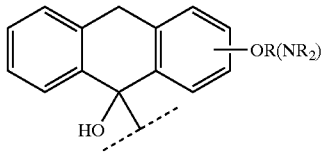

-continued

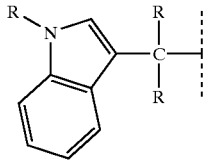

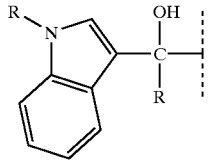

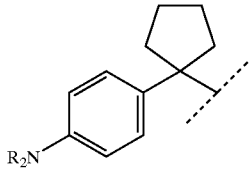

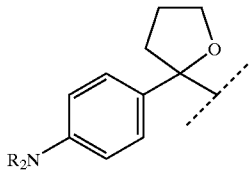

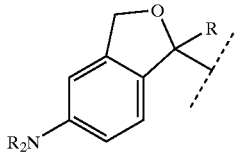

In the structures of this patent application a designation such as—$OR(NR_2)$ indicates that either —OR or —$NR_2$ can be present.

The following are illustrative examples of the group X of general structure

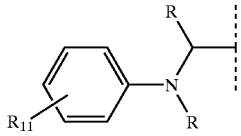

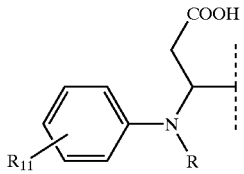

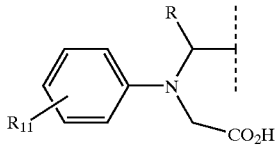

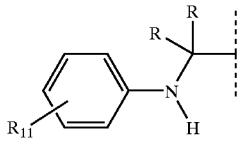

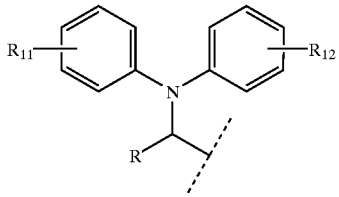

-continued $R_{11}$ and $R_{12}$ = { H, alkyl, alkoxy, alkylthio, halo, carbamoyl; carboxyl, amido, formyl, sulfonyl, sulfonamido, nitrile }

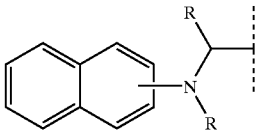

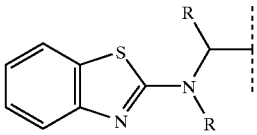

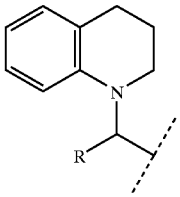

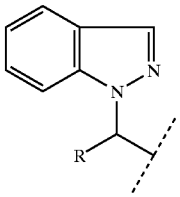

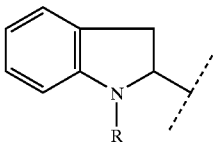

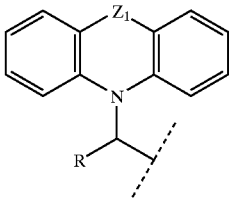

$Z_1$=a covalent bond, S, O, Se, NR, $CR_2$, CR═CR, or $CH_2CH_2$.

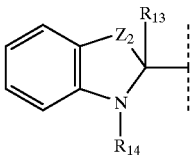

$Z_2$=S, O, Se, NR, $CR_2$, CR═CR, $R_{13}$,=alkyl, substituted alkyl or aryl, and $R_{14}$=H, alkyl substituted alkyl or aryl.

The following are illustrative examples of the group X of the general structure III:

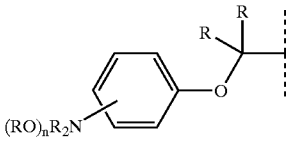

-continued

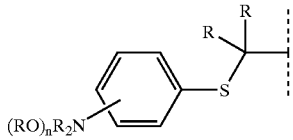

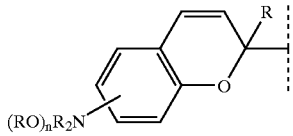

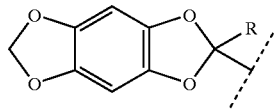

n = 1–3

The following are illustrative examples of the group X of the general structure IV:

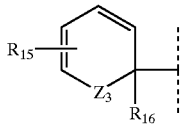

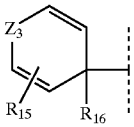

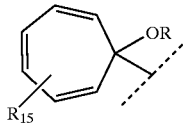

$Z_3$=O, S, Se, NR
$R_{15}$=R, OR, $NR_2$
$R_{16}$=alkyl, substituted alkyl
Preferred Y' groups are:

(1) X', where X' is an X group as defined in structures I–IV and may be the same as or different from the X group to which it is attached (2)

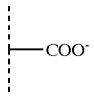

(3)

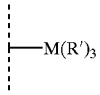

where M = Si, Sn or Ge; and R′ = alkyl or substituted alkyl (4)

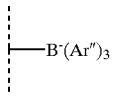

where Ar″ = aryl or substituted aryl (5)

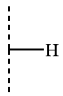

In preferred embodiments of this invention Y' is —H, —$COO^-$ or —$Si(R')_3$ or —X'. Particularly preferred Y' groups are —H, —$COO^-$ or —$Si(R')_3$.

In embodiments of the invention in which Y' is a proton, a base, $\beta^-$, is present in the emulsion layer and may be covalently linked directly or indirectly to X. The base is preferably the conjugate base of an acid of pKa between about 1 and about 8, preferably about 2 to about 7. Collections of pKa values are available (see, for example: Dissociation Constants of Organic Bases in Aqueous Solution, D. D. Perrin (Butterworths, London, 1965); CRC Handbook of Chemistry and Physics, 77th ed, D. R. Lide (CRC Press, Boca Raton, Fla., 1996)). Examples of useful bases are included in Table I.

TABLE I

| pKa's in water of the conjugate acids of some useful bases | |
|---|---|
| $CH_3—CO_2^-$ | 4.76 |
| $C_2H_5—CO_2^-$ | 4.87 |
| $(CH_3)_2CH—CO_2^-$ | 4.84 |
| $(CH_3)_3C—CO_2^-$ | 5.03 |
| $HO—CH_2—CO_2^-$ | 3.83 |
| 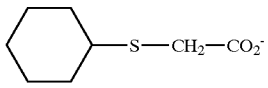 | 3.48 |
| $CH_3—CO—NH—CH_2—CO_2^-$ | 3.67 |
| 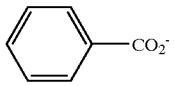 | 4.19 |
| 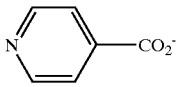 | 4.96 |
| $CH_3—COS^-$ | 3.33 |
| 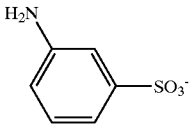 | 3.73 |
| 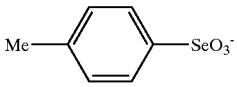 | 4.88 |
| 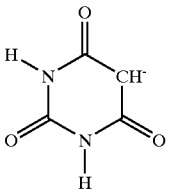 | 4.01 |
| 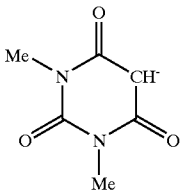 | 4.7 |
| $(CH_3)_3\overset{+}{N}—\overset{-}{O}$ | 4.65 |
| $H_2N—CH_2—CH(CH_3)—\overset{+}{N}H_3$ | 6.61 |
| 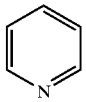 | 5.25 |
| 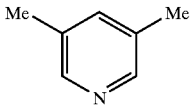 | 6.15 |
| 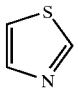 | 2.44 |
| 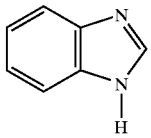 | 5.53 |

Preferably the base, $\beta^-$ is a carboxylate, sulfate or amine oxide.

In some embodiments of the invention, the fragmentable electron donating compound contains a light absorbing group, Z, which is attached directly or indirectly to X, a silver halide absorptive group, A, directly or indirectly attached to X, or a chromophore forming group, Q, which is attached to X. Such fragmentable electron donating compounds are preferably of the following formulae:

$Z—(L—X—Y')_k$ $A—(L—X—Y')_k$ $(A—L)_k—X—Y'$ $Q—X—Y'$ $A—(X—Y')_k$ $(A)_k—X—Y'$ $Z—(X—Y')_k$ or $(Z)_k—X—Y'$

Z is a light absorbing group;

k is 1 or 2;

A is a silver halide adsorptive group that preferably contains at least one atom of N, S, P, Se, or Te that promotes adsorption to silver halide;

L represents a linking group containing at least one C, N, S, $\beta^-$ or 0 atom; and Q represents the atoms necessary to form a chromophore comprising an amidinium-ion, a carboxyl-ion or dipolar-amidic chromophoric system when conjugated with X—Y'.

Z is a light absorbing group including, for example, cyanine dyes, complex cyanine dyes, merocyanine dyes, complex merocyanine dyes, homopolar cyanine dyes, styryl dyes, oxonol dyes, hemioxonol dyes, and hemicyanine dyes.

Preferred Z groups are derived from the following dyes:

Dye 1

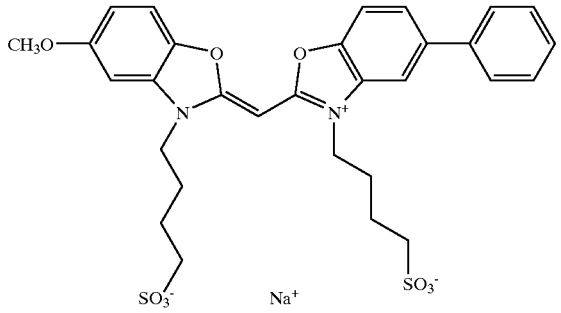

Dye 2

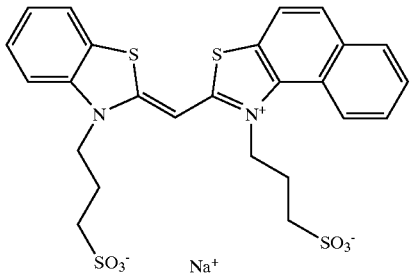

Dye 3

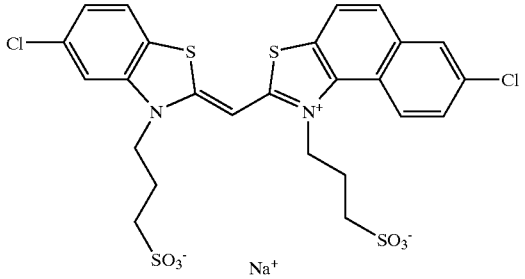

Dye 4

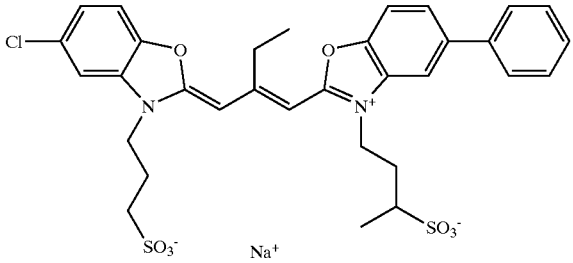

Dye 5

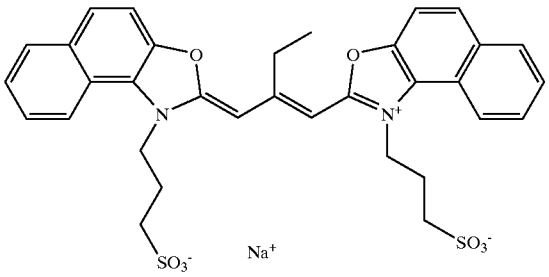

-continued

Dye 6

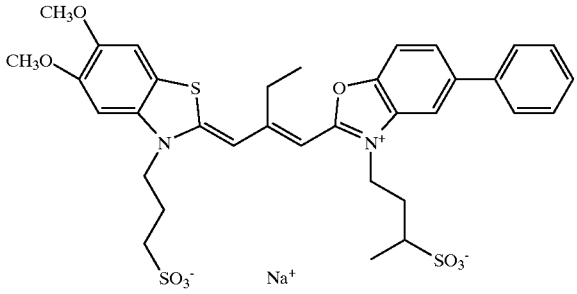

Dye 7

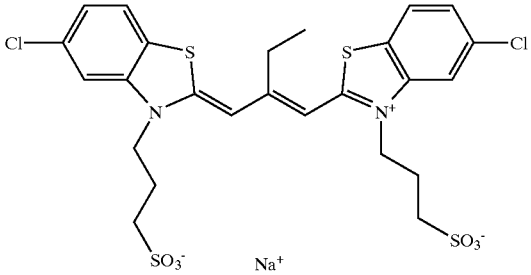

and

Dye 8

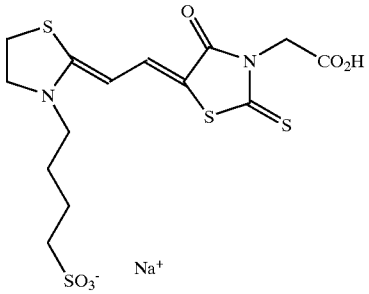

The linking group L may be attached to the dye at one (or more) of the heteroatoms, at one (or more) of the aromatic or heterocyclic rings, or at one (or more) of the atoms of the polymethine chain, at one (or more) of the heteroatoms, at one (or more) of the aromatic or heterocyclic rings, or at one (or more) of the atoms of the polymethine chain. For simplicity, and because of the multiple possible attachment sites, the attachment of the L group is not specifically indicated in the generic structures.

The silver halide adsorptive group A is preferably a silver-ion ligand moiety or a cationic surfactant moiety. In preferred embodiments, A is selected from the group consisting of: i) sulfur acids and their Se and Te analogs, ii) nitrogen acids, iii) thioethers and their Se and Te analogs, iv) phosphines, v) thionamides, selenamides, and telluramides, and vi) carbon acids.

Illustrative A groups include:

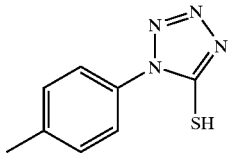

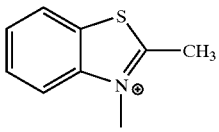

-continued

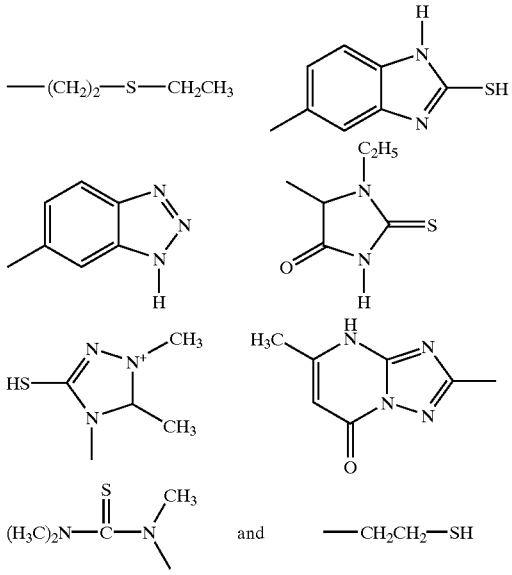

The point of attachment of the linking group L to the silver halide adsorptive group A will vary depending on the structure of the adsorptive group, and may be at one (or more) of the heteroatoms, at one (or more) of the aromatic or heterocyclic rings.

The linkage group represented by L which connects the light absorbing group to the fragmentable electron donating group XY by a covalent bond is preferably an organic linking group containing a least one C, N, S, or O atom. It is also desired that the linking group not be completely aromatic or unsaturated, so that a pi-conjugation system cannot exist between the Z and XY moieties. Preferred examples of the linkage group include, an alkylene group, an arylene group, —O—, —S—, —C═O, —$SO_2$—, —NH—, —P═O, and —N═. Each of these linking components can be optionally substituted and can be used alone or in combination. Examples of preferred combinations of these groups are:

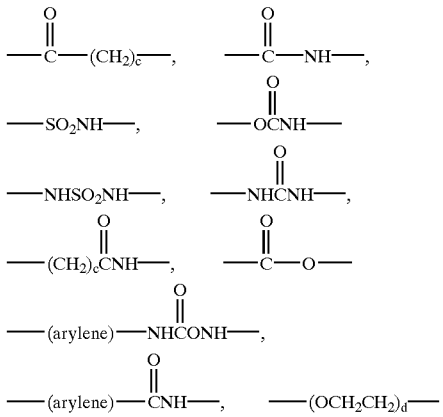

where c = 1–30, and d = 1–10

The length of the linkage group can be limited to a single atom or can be much longer, for instance up to 30 atoms in length. A preferred length is from about 2 to 20 atoms, and most preferred is 3 to 10 atoms. Some preferred examples of L can be represented by the general formulae indicated below:

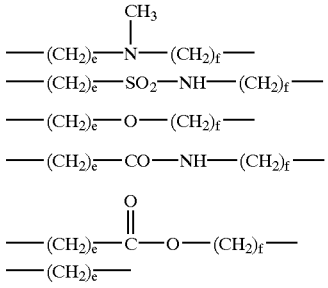

e and f=1–30, with the proviso that e+f≦31

Q represents the atoms necessary to form a chromophore comprising an amidinium-ion, a carboxyl-ion or dipolar-amidic chromophoric system when conjugated with X—Y'. Preferably the chromophoric system is of the type generally found in cyanine, complex cyanine, hemicyanine, merocyanine, and complex merocyanine dyes as described in F. M. Hamer, *The Cyanine Dyes and Related Compounds* (Interscience Publishers, New York, 1964).

Illustrative Q groups include:

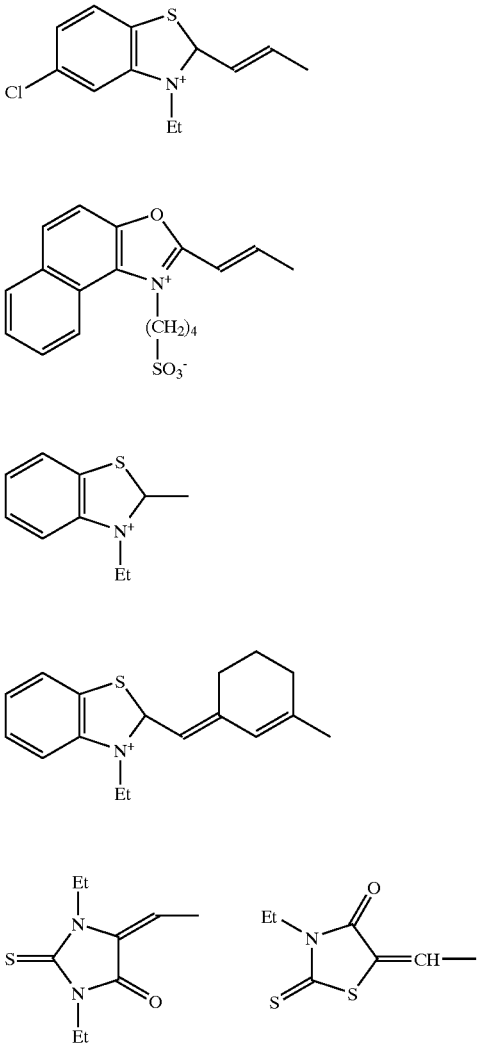

-continued

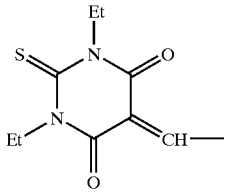

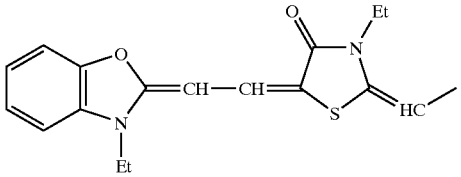

Particularly preferred are Q groups of the formula:

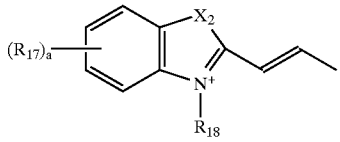

wherein:

$X_2$ is O, S, N, or $C(R_{19})_2$, where $R_{19}$ is substituted or unsubstituted alkyl. each $R_{17}$ is independently a hydrogen atom, a halogen atom, a substituted or unsubstituted alkyl group, or substituted or unsubstituted aryl group;

a is an integer of 1–4;

and $R_{18}$ is substituted or unsubstituted alkyl, or substituted or unsubstituted aryl.

Illustrative fragmentable electron donating compounds include:

FED 1

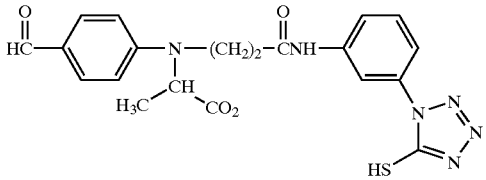

FED 2

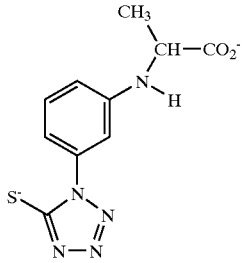

FED 3

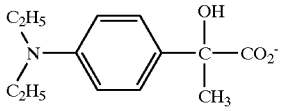

FED 4

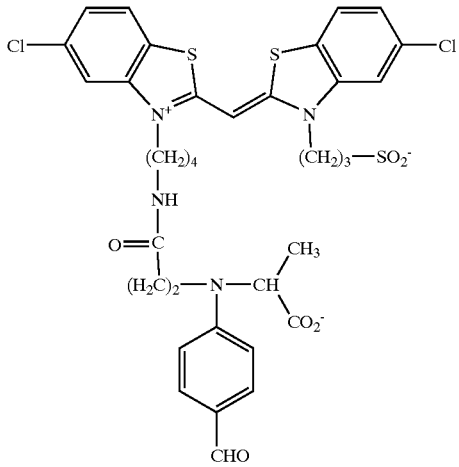

FED 5

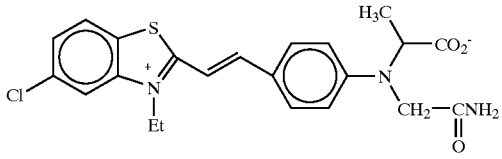

FED 6

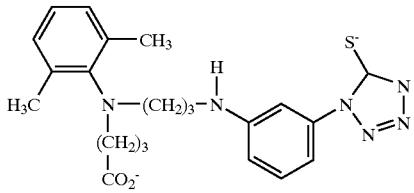

-continued
FED 7
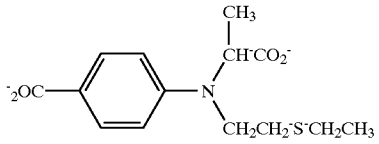
FED 8
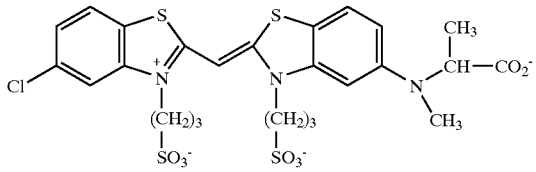
FED 9
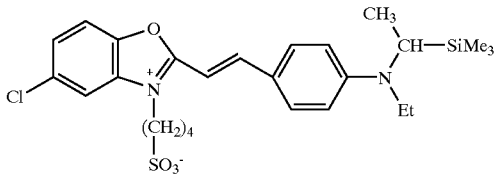
FED 10
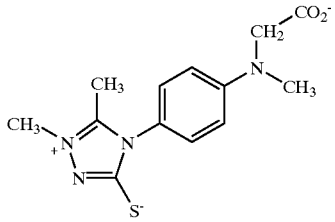
FED 11
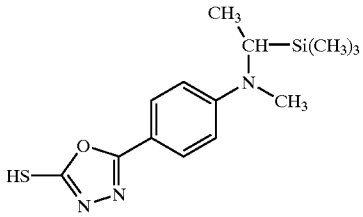
FED 12
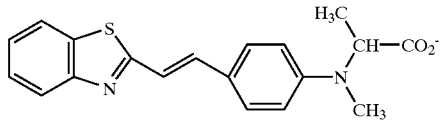
FED 13
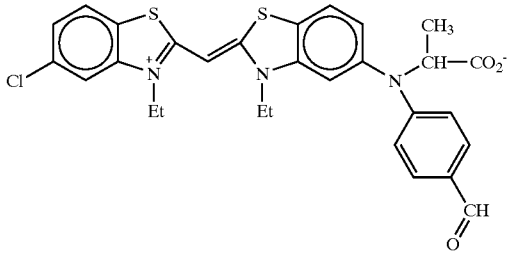
FED 14
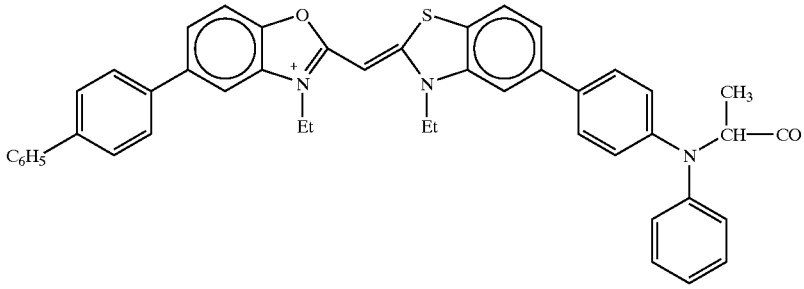
FED 15
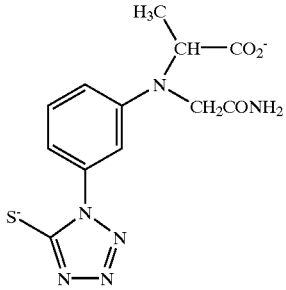

-continued
FED 16
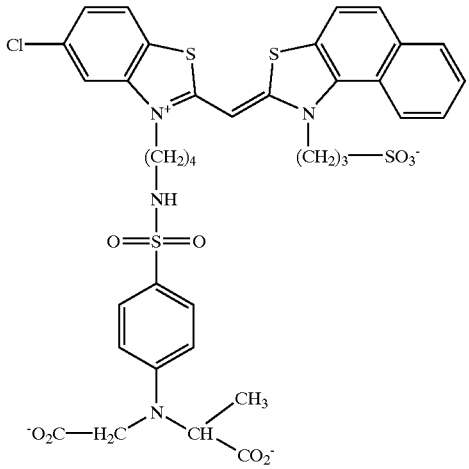
FED 17
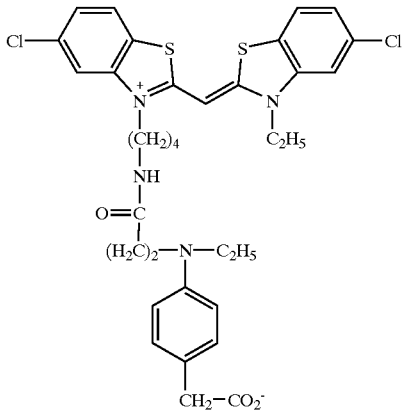
FED 18
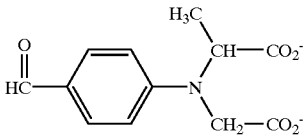
FED 19
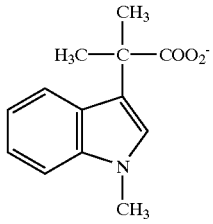
FED 20
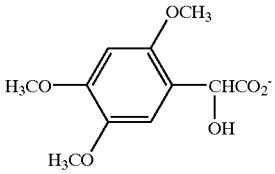
FED 21
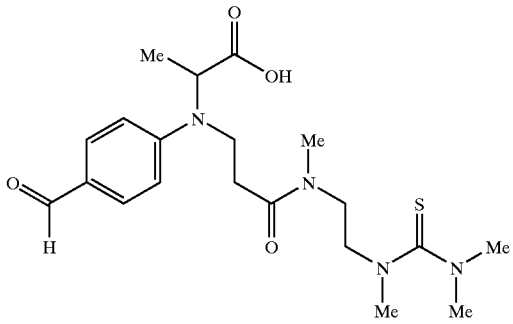
FED 22
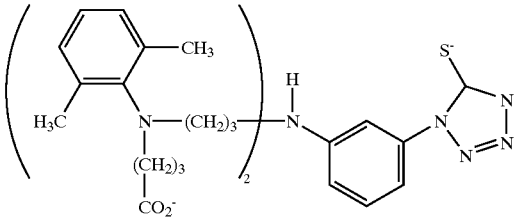

The fragmentable electron donors of the present invention can be included in a silver halide emulsion by direct dispersion in the emulsion, or they may be dissolved in a solvent such as water, methanol or ethanol for example, or in a mixture of such solvents, and the resulting solution can be added to the emulsion. The compounds of the present invention may also be added from solutions containing a base and/or surfactants, or may be incorporated into aqueous slurries or gelatin dispersions and then added to the emulsion. The fragmentable electron donor may be used as the sole sensitizer in the emulsion. However, in preferred embodiments of the invention a sensitizing dye is also added to the emulsion. The compounds can be added before, during or after the addition of the sensitizing dye. The amount of electron donor which is employed in this invention may range from as little as $1\times10^{-8}$ mole per mole of silver in the emulsion to as much as about 0.1 mole per mole of silver, preferably from about $5\times10^{-7}$ to about 0.05 mole per mole of silver. Where the oxidation potential $E_1$ for the XY moiety of the electron donating sensitizer is a relatively low potential, it is more active, and relatively less agent need be employed. Conversely, where the oxidation potential for the XY moiety of the electron donating sensitizer is relatively high, a larger amount thereof, per mole of silver, is employed. In addition, for XY moieties that have silver halide adsorptive groups A or light absorptive groups Z or chromophoric groups Q directly or indirectly attached to X, the fragmentable electron donating sensitizer is more closely associated with the silver halide grain and relatively less agent need be employed. For fragmentable one-electron donors relatively larger amounts per mole of silver are also employed. Although it is preferred that the fragmentable electron donor be added to the silver halide emulsion prior to manufacture of the coating, in certain instances, the electron donor can also be incorporated into the emulsion after exposure by way of a pre-developer bath or by way of the developer bath itself.

Fragmentable electron donating compounds are described more fully in U.S. Pat. Nos. 5,747,235, 5,747,236, 5,994,051, 6,010,841, and 6,054,269, and published European Patent Application 893,732, the entire disclosures of these patents and patent application are incorporated herein by reference.

Various compounds may be added to the photographic material of the present invention for the purpose of lowering the fogging of the material during manufacture, storage, or processing. Typical antifoggants are discussed in Section VI of Research Disclosure I, for example tetraazaindenes, mercaptotetrazoles, polyhydroxybenzenes, hydroxyaminobenzenes, combinations of a thiosulfonate and a sulfinate, and the like.

For this invention, polyhydroxybenzene and hydroxyaminobenzene compounds (hereinafter "hydroxybenzene compounds") are preferred as they are effective for lowering fog without decreasing the emulsion sensitivity. Examples of hydroxybenzene compounds are:

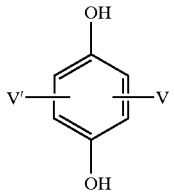

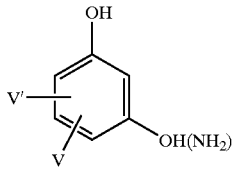

-continued

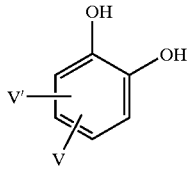

In these formulae, V and V' each independently represent —H, —OH, a halogen atom, —OM (M is alkali metal ion), an alkyl group, a phenyl group, an amino group, a carbonyl group, a sulfone group, a sulfonated phenyl group, a sulfonated alkyl group, a sulfonated amino group, a carboxyphenyl group, a carboxyalkyl group, a carboxyamino group, a hydroxyphenyl group, a hydroxyalkyl group, an alkylether group, an alkylphenyl group, an alkylthioether group, or a phenylthioether group.

More preferably, they each independently represent —H, —OH, —Cl, —Br, —COOH, $—CH_2CH_2COOH$, $—CH_3$, $—CH_2CH_3$, $—C(CH_3)_3$, $—OCH_3$, —CHO, $—SO_3K$, $—SO_3Na$, $—SO_3H$, $—SCH_3$, or -phenyl.

Especially preferred hydroxybenzene compounds follow:

HB1

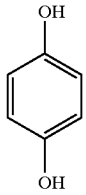

HB2

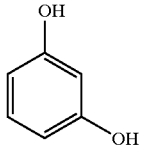

HB3

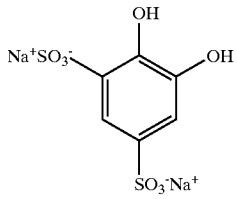

HB4

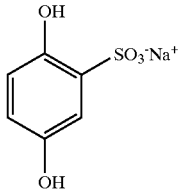

HB5

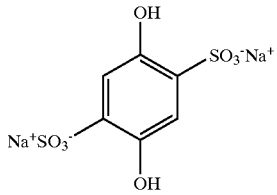

-continued

HB6

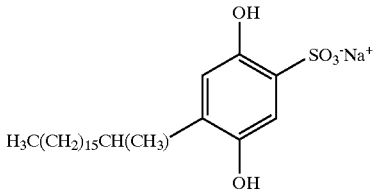

HB7

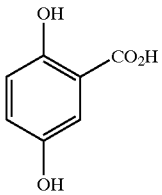

HB8

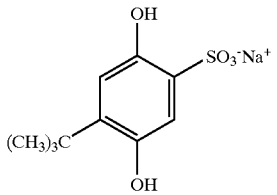

HB9

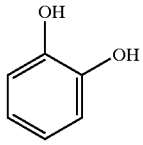

HB10

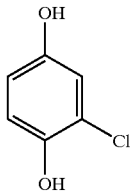

HB11

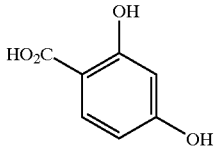

HB12

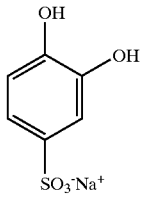

HB13

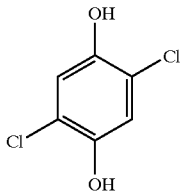

-continued

HB14

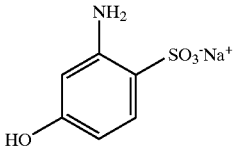

HB15

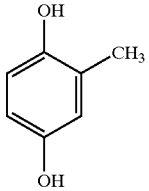

Hydroxybenzene compounds may be added to the emulsion layers or any other layers constituting the photographic material of the present invention. The preferred amount added is from $1\times10^{-3}$ to $1\times10^{-1}$ mol, and more preferred is $1\times10^{-3}$ to $2\times10^{-2}$ mol, per mol of silver halide.

The photographic element of the present invention comprises at least one light sensitive silver halide layer coated on a support having a low permeability to oxygen. Oxygen permeability for support of a given thickness can be measured as the volume of oxygen gas diffusing through one square meter of the support during a fixed time period (i.e one day), using procedures defined in ASTM D3985. Table II below lists values for oxygen permeability for some typical polymeric support materials useful in photographic elements. It can be seen from the table that both PET (polyethylene terephthalate support) and PEN (polyethylene napthalate support) have low oxygen permeability (defined as a permeability less than or equal to about 100 cc/m$^2$/day at typical useful support thicknesses. These polyester supports also offer the advantages of imparting increased dimensional stability or mechanical strength to the photographic element, as described in U.S. Pat. No. 3,649,336. Polyethylene terephthalate ("PET") and polyethylene naphthalate ("PEN") supports both have improved mechanical strength and curl relaxation characteristics when compared with cellulose triacetate ("acetate") and other supports. In preferred embodiments of the invention the support has an oxygen permeability equal to or less than about 50 cc/m$^2$/day, or more preferably equal to or less than about 25 cc/m$^2$/day.

TABLE II

Oxygen permeability of various supports

| Support | thickness (mil) | $O_2$ permeability @25C 0%RH (cc/m$^2$/day) | $O_2$ permeability @25C 50%rh (cc/m$^2$/day) |
|---|---|---|---|
| PET | 3.9 | 16 | 13 |
| polycarbonate | 5.5 | 581 | 531 |
| syndiotactic polystyrene | 4.9 | 1973 | 1963 |
| cellulose triacetate | 4.9 | 797 | 605 |
| PEN | 3.4 | 4.3 | 3.7 |

The supports which can be used in this invention include any polyester support, preferably those that are hydrophobic, high molecular weight polyesters. Suitable supports typically have a glass transition temperature (Tg) greater than 90° C. The support may be produced from any suitable synthetic linear polyester which may be obtained by condensing one or more dicarboxylic acids or their lower alkyl esters, e.g., terephthalic acid, isophthalic, phthalic, 2,5-, 2,6-, and 2,7-naphthalene dicarboxylic acid, succinic acid, sebacic acid, adipic acid, azelaic acid, diphenyl dicarboxylic acid, and hexahydroterephthalic acid or bis-p-carboxyl phenoxy ethane, optionally with a monocarboxylic acid, such as povalic acid, with one or more glycols, e.g., ethylene glycol, 1,3-propanediol, 1,4-butanediol, neopentyl glycol and 1,4cyclohexanedimethanol. Suitable supports include, for example, polyesters such as polyethylene terephthalate, polyhexamethylene terephthalate, polyethylene-2,6-naphthalate, polyethylene-2,5-naphthalate, and polyethylene-2,7-naphthalate. An especially useful polyester film support is that formed from poly(ethylene terephthalate) or poly(ethylene naphthalate). Particularly suitable for use with this invention is a support composed primarily of polyethylene-2,6-naphthalate. Within the contemplation of the invention are supports based on copolymers and/or mixtures of polyesters based on different monomers. Also contemplated are additions of any subbing(s) or treatment or combination of subbing(s) and/or treatment as needed to make the support suitable for adhesion of gel and inclusion of magnetic particles and lubricants antistats etc as to make more suitable for photographic usage.

The emulsion layer of the photographic element of the invention can comprise any one or more of the light sensitive layers of the photographic element. The photographic elements made in accordance with the present invention can be black and white elements, single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

The photographic elements of the present invention may also use colored couplers (e.g. to adjust levels of interlayer correction) and masking couplers such as those described in EP 213 490; Japanese Published Application 58–172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); development inhibitors and their precursors (U.S. Pat. No. 5,460,932; U.S. Pat. No. 5,478,711); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

In the following discussion, reference will be made to *Research Disclosure*, September 1996, Number 389, Item 38957, which will be identified hereafter by the term "*Research Disclosure I*." This and all other Research Disclosures referenced herein are published by Kenneth Mason Publications, Ltd., Dudley Annex, 12a North Street, Emsworth, Hampshire P010 7DQ, ENGLAND. The Sections hereafter referred to are Sections of the *Research Disclosure I* unless otherwise indicated.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains.

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). Tabular grain emulsions are those in which the tabular grains account for at least 50 percent (preferably at least 70 percent and optimally at least 90 percent) of the total grain projected area. Preferred tabular grain emulsions are those in which the average thickness of the tabular grains is less than 0.3 micrometer (preferably thin—that is, less than 0.2 micrometer. The major faces of the tabular grains can lie in either {111} or {100} crystal planes. The mean ECD of tabular grain emulsions rarely exceeds 10 micrometers and more typically is less than 5 micrometers.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435,501, 4,463,087 and 4,173,320, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771, '772, '773, 5,171,659 and 5,252,453, Black et al 5,219,720 and 5,334,495, Delton U.S. Pat. Nos. 5,310,644, 5,372,927 and 5,460,934, Wen U.S. Pat. No. 5,470,698, Fenton et al U.S. Pat. No. 5,476,760, Eshelman et al U.S. Pat. Nos. 5,612,175 and 5,614,359, and Irving et al U.S. Pat. No. 5,667,954.

Ultrathin high bromide {111 } tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955. High bromide {100} tabular grain emulsions are illustrated by Mignot U.S. Pat. Nos. 4,386,156 and 5,386,156.

High chloride {111 } tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, and Maskasky et al U.S. Pat. Nos. 5,176,992 and 5,178,998. Ultrathin high chloride {111 } tabular grain emulsions are illustrated by Maskasky U.S. Pat. Nos. 5,271,858 and 5,389,509.

High chloride {100} tabular grain emulsions are illustrated by Maskasky U.S. Pat. Nos. 5,264,337, 5,292,632, 5,275,930 and 5,399,477, House et al U.S. Pat. No. 5,320,938, Brust et al U.S. Pat. No. 5,314,798, Szajewski et al U.S. Pat. No. 5,356,764, Chang et al U.S. Pat. Nos. 5,413,904 and 5,663,041, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570. Photographic elements can be exposed to actinic radiation, typically in the visible region of the spectrum, to form a latent image and can then be processed to form a visible dye image as already described above.

In the course of grain precipitation one or more dopants (grain occlusions other than silver and halide) can be introduced to modify grain properties. For example, any of the various conventional dopants disclosed in Research Disclosure, Item 36544, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in Research Discolosure Item 36736 published November 1994, here incorporated by reference.

The SET dopants are effective at any location within the grains. Generally better results are obtained when the SET dopant is incorporated in the exterior 50 percent of the grain, based on silver. An optimum grain region for SET incorporation is that formed by silver ranging from 50 to 85 percent of total silver forming the grains. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

SET dopants are known to be effective to reduce reciprocity failure. In particular the use of iridium hexacoordination complexes or $Ir^{+4}$ complexes as SET dopants is advantageous.

Iridium dopants that are ineffective to provide shallow electron traps (non-SET dopants) can also be incorporated into the grains of the silver halide grain emulsions to reduce reciprocity failure. To be effective for reciprocity improvement the Ir can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations.

Although generally preferred concentration ranges for the various SET and non-SET Ir dopants have been set out above, it is recognized that specific optimum concentration ranges within these general ranges can be identified for specific applications by routine testing. It is specifically contemplated to employ the SET and non-SET Ir dopants singly or in combination. For example, grains containing a combination of an SET dopant and a non-SET Ir dopant are specifically contemplated.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions.

The silver halide to be used in the invention may be advantageously subjected to chemical sensitization. Compounds and techniques useful for chemical sensitization of silver halide are known in the art and described in *Research Disclosure I* and the references cited therein. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C., as described in *Research Disclosure I*, Section IV (pages 510–511) and the references cited therein.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol. The dye/silver halide emulsion may be mixed with a dispersion of color image-forming coupler immediately before coating or in advance of coating (for example, 2 hours). Typical sensitizing dyes for use with fragmentable electron donors are described in U.S. Pat. No. 5,747,236, incorporated herein by reference.

Photographic elements of the present invention are preferably imagewise exposed using any of the known techniques, including those described in *Research Disclosure I*, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like). Where photographic elements of the present invention are intended as duplicating films or as print materials, the exposure is typically made by passing light in the visible region through a color negative or positive image and appropriate focussing lenses.

Photographic elements comprising the composition of the invention can be processed in any of a number of well-known photographic processes utilizing any of a number of well-known processing compositions, described, for example, in *Research Disclosure I*, or in T. H. James, editor, *The Theory of the Photographic Process*, 4th Edition, Macmillan, New York, 1977. In the case of processing a negative working color element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethylaniline sesquisulfate hydrate, 4-amino-3-methyl-N-ethyl-N-(O-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, *Research Disclosure*, Vol. 116, December, 1973, Item 11660, and Bissonette *Research Disclosure*, Vol. 148, August, 1976, Items 14836, 14846 and 14847. The photographic elements can be particularly adapted to form dye images by such processes as illustrated by Dunn et al U.S. Pat. No. 3,822,129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. 5,324,624, Fyson EPO 0 487 616, Tannahill et al WO 90/13059, Marsden et al WO 90/13061, Grimsey et al WO 91/16666, Fyson WO 91/17479, Marsden et al WO 92/01972. Tannahill WO 92/05471, Henson WO 92/07299, Twist WO 93/01524 and WO 93/11460 and Wingender et al German OLS 4,211,460.

Color development is usually followed by the conventional steps of bleaching, fixing, or bleach-fixing, to remove silver or silver halide, washing, and drying. Black and white development is usually followed by the conventional steps of fixing (to remove silver halide), washing and drying.

The photographic elements of this invention may be processed utilizing either conventional processing systems, described above or low volume processing systems.

Low volume systems are those where film processing is initiated by contact to a processing solution, but where the processing solution volume is comparable to the total volume of the imaging layer to be processed. This type of system may include the addition of non-solution processing aids, such as the application of heat or of a laminate layer that is applied at the time of processing. Conventional photographic systems are those where film elements are processed by contact with conventional photographic processing solutions, and the volume of such solutions is very large in comparison to the volume of the imaging layer.

Low volume processing is defined as processing where the volume of applied developer solution is between about 0.1 to about 10 times, preferably about 0.5 to about 10 times, the volume of solution required to swell the photographic element. This processing may take place by a combination of solution application, external layer lamination, and heating. The low volume system photographic element may receive some or all of the following treatments:

(I) Application of a solution directly to the film by any means, including spray, inkjet, coating, gravure process and the like.

(II) Soaking of the film in a reservoir containing a processing solution. This process may also take the form of dipping or passing an element through a small cartridge.

(III) Lamination of an auxiliary processing element to the imaging element. The laminate may have the purpose of providing processing chemistry, removing spent chemistry, or transferring image information from the latent image recording film element. The transferred image may result from a dye, dye precursor, or silver containing compound being transferred in a image-wise manner to the auxiliary processing element.

(IV) Heating of the element by any convenient means, including a simple hot plate, iron, roller, heated drum, microwave heating means, heated air, vapor, or the like. Heating may be accomplished before, during, after, or throughout any of the preceding treatments I–III. Heating may cause processing temperatures ranging from room temperature to 100° C.

Photographic elements and methods of processing such elements particularly suitable for use with this invention are described in *Research Disclosure*, February 1995, Item 37038, incorporated herein by reference.

The processed photographic elements of this invention may serve as origination material for some or all of the following processes: image scanning to produce an electronic rendition of the capture image, and subsequent digital processing of that rendition to manipulate, store, transmit, output, or display electronically that image. A number of modifications of color negative elements have been suggested for accommodating scanning, as illustrated by *Research Disclosure*, I Section XIV. Scan facilitating features *Research Disclosure*, and *Research Disclosure* September 1994, Item 36544. These systems are contemplated for use in the practice of this invention. Further examples of such processes and useful film features are also described in U.S. Pat. No. 5,840,470; U.S. Pat. No. 6,045,938; U.S. Pat. No. 6,021,277; EP 961,482 and EP905,651

For example, it is possible to scan the photographic element successively within the blue, green, and red regions of the spectrum or to incorporate blue, green, and red light within a single scanning beam that is divided and passed through blue, green, and red filters to form separate scanning beams for each color record. A simple technique is to scan the photographic element point-by-point along a series of laterally offset parallel scan paths. The intensity of light passing through the element at a scanning point is noted by a sensor, which converts radiation received into an electrical signal. Most generally this electronic signal is further manipulated to form a useful electronic record of the image. For example, the electrical signal can be passed through an analog-to-digital converter and sent to a digital computer together with location information required for pixel (point) location within the image. In another embodiment, this electronic signal is encoded with colorimetric or tonal information to form an electronic record that is suitable to allow reconstruction of the image into viewable forms such as computer monitor displayed images, television images, printed images, and so forth.

It is contemplated that many of imaging elements of this invention will be scanned prior to the removal of silver halide from the element. The remaining silver halide yields a turbid coating, and it is found that improved scanned image quality for such a system can be obtained by the use of scanners that employ diffuse illumination optics. Any technique known in the art for producing diffuse illumination can be used. Preferred systems include reflective systems, that employ a diffusing cavity whose interior walls are specifically designed to produce a high degree of diffuse reflection, and transmissive systems, where diffusion of a beam of specular light is accomplished by the use of an optical element placed in the beam that serves to scatter light. Such elements can be either glass or plastic that either incorporate a component that produces the desired scattering, or have been given a surface treatment to promote the desired scattering.

One of the challenges encountered in producing images from information extracted by scanning is that the number of pixels of information available for viewing is only a fraction of that available from a comparable classical photographic print. It is, therefore, even more important in scan imaging to maximize the quality of the image information available. Enhancing image sharpness and minimizing the impact of aberrant pixel signals (i.e., noise) are common approaches to enhancing image quality. A conventional technique for minimizing the impact of aberrant pixel signals is to adjust each pixel density reading to a weighted average value by factoring in readings from adjacent pixels, closer adjacent pixels being weighted more heavily. The elements of the invention can have density calibration patches derived from one or more patch areas on a portion of unexposed photographic recording material that was subjected to reference exposures, as described by Wheeler et al U.S. Pat. No. 5,649,260, Koeng at al U.S. Pat. No. 5,563,717, Cosgrove et al U.S. Pat. No. 5,644,647, and Reem and Sutton U.S. Pat. No. 5,667,944.

Illustrative systems of scan signal manipulation, including techniques for maximizing the quality of image records, are disclosed by Bayer U.S. Pat. No. 4,553,156; Urabe et al U.S. Pat. No. 4,591,923; Sasaki et al U.S. Pat. No. 4,631,578; Alkofer U.S. Pat. No. 4,654,722; Yamada et al U.S. Pat. No. 4,670,793; Klees U.S. Pat. Nos. 4,694,342 and 4,962,542; Powell U.S. Pat. No. 4,805,031; Mayne et al U.S. Pat. No. 4,829,370; Abdulwahab U.S. Pat. No. 4,839,721; Matsunawa et al U.S. Pat. Nos. 4,841,361 and 4,937,662; Mizukoshi et al U.S. Pat. No. 4,891,713; Petilli U.S. Pat. No. 4,912,569; Sullivan et al U.S. Pat. Nos. 4,920,501 and 5,070,413; Kimoto et al U.S. Pat. No. 4,929,979; Hirosawa et al U.S. Pat. No. 4,972,256; Kaplan U.S. Pat. No. 4,977,521; Sakai U.S. Pat. No. 4,979,027; Ng U.S. Pat. No. 5,003,494; Katayama et al U.S. Pat. No. 5,008,950; Kimura et al U.S. Pat. No. 5,065,255; Osamu et at U.S. Pat. No. 5,051,842; Lee et al U.S. Pat. No. 5,012,333; Bowers et al U.S. Pat. No. 5,107,346; Telle U.S. Pat. No. 5,105,266; MacDonald et al U.S. Pat. No. 5,105,469; and Kwon et al U.S. Pat. No. 5,081,692. Techniques for color balance adjustments during scanning are disclosed by Moore et al U.S. Pat. No. 5,049,984 and Davis U.S. Pat. No. 5,541,645. Color image reproduction of scenes with color enhancement and preferential tone-scale mapping are described by Burh et al. in U.S. Pat. Nos. 5,300,381 and 5,528,339.

The digital color records once acquired are in most instances adjusted to produce a pleasingly color balanced image for viewing and to preserve the color fidelity of the image bearing signals through various transformations or renderings for outputting, either on a video monitor or when printed as a conventional color print. Preferred techniques for transforming image bearing signals after scanning are disclosed by Giorgianni et at U.S. Pat. No. 5,267,030, the disclosures of which are herein incorporated by reference. The signal transformation techniques of Giorgianni et al '030 described in connection with FIG. 8 represent a specifically preferred technique for obtaining a color balanced image for viewing.

Further illustrations of the capability of those skilled in the art to manage color digital image information are provided by Giorgianni and Madden *Digital Color Management*, Addison-Wesley, 1998.

The following examples illustrate the preparation and evaluation of photographic elements of the invention.

EXAMPLES

Emulsions

An AgBrI tabular silver halide emulsion (Emulsion E-1) was prepared containing 3.7% total iodide distributed such that the central portion of the emulsion grains contained 1.0% I and the perimeter area contained substantially higher iodide as described by Chang et. al., U.S. Pat. No. 5,314,793. The emulsion grains had an average thickness of 0.11 $\mu$m and average circular diameter of 4.35 $\mu$m. Emulsion E-1 was precipitated using oxidized gelatin and contained low levels of $K_4Ru(CN)_6$ and KSeCN as dopants added during precipitation.

Emulsion 2=3.2 mole % iodide, constrained to the grain core (before 71% of precipitation is complete). The emulsion grains had an average thickness of 0.13 $\mu$m and average circular diameter of 3.4 $\mu$m.

Emulsion 3=3.7 mole % iodide with all of the iodide added after 71% of the precipitation. The emulsion grains had an average thickness of 0.12 $\mu$m and average circular diameter of 2.8 $\mu$m.

Emulsion 4=4.1 mole % iodide distributed such that the central portion of the emulsion grains contained 1.5% I and the perimeter area contained substantially higher iodide.

The emulsion grains had an average thickness of 0.13 $\mu$m and average circular diameter of 2.7 $\mu$m.

The emulsions were optimally chemically and spectrally sensitized using NaSCN, the blue sensitizing dye BSD-1, a benzothiazolium finish modifier, aurous dithiosulfate and sodium thiosulfate pentahydrate and then subjecting the emulsions to a heat cycle to 60° C. After cooling to 40° C.; ADD-6 was added at 500 mg/mol silver and HB3 at 200 mg/mol silver. For some experimental variations, a fragmentable electron donating sensitizing agent was added to the emulsions after the heat cycle but prior to coating.

Photographic Examples

Multilayer film examples demonstrating the principles of this invention were produced by coating these emulsion samples on film support (coverages are in grams per square meter unless otherwise stated, emulsion sizes as determined by the Electric Field Birefringence method for diameter and Coated Reflectance method for thickness and are reported in Diameter×Thickness in microns). Each emulsion sample was coated in layer 10, the experimental layer.

ML-Example 1: Support=cellulose triacetate, 4.9 mil thickness (comparative)

Layer 1 (Antihalation layer): black colloidal silver sol at 0.172; ILS-1 at 0.135, DYE-1 at 0.031; DYE-5 at 0.028; DYE-6 at 0.025; ADD-1 at 0.001; ADD-2 at 0.110; ADD-3 at 0.055; HB3 at 0.915; and gelatin at 2.05.

Layer 2 (Slow cyan layer): a blend of two red sensitized (both with a mixture of RSD-1 and RSD-2) tabular silver iodobromide emulsions: (i) 1.0×0.09 microns, 4.1 mole % I at 0.323 (ii) 0.55×0.08 micron, 1.5 mole % I at 0.431; cyan dye-forming coupler C-1 at 0.535; bleach accelerator releasing coupler B-1 at 0.031; masking coupler MC-1 at 0.03; ADD-6 at 1.8 g/mol silver and gelatin at 2.024.

Layer 3 (Mid cyan layer): a red sensitized (as above) tabular silver iodobromide emulsion: (i) 1.25×0.12, 4.1 mole % I at 0.883; cyan coupler C-1 at 0.105; DIR-1 at 0.093; MC-1 at 0.018; ADD-6 at 1.8 g/mol silver and gelatin at 1.012

Layer 4 (Fast cyan layer): a red sensitized (as above) tabular silver iodobromide emulsion (2.2×0.13, 4.1 mole % I) at 1.076; C-1 at 0.120; DIR-1 at 0.019; MC-1 at 0.032; ADD-6 at 1.8 g/mol silver; ADD-7 at 0.05 mg/mol silver and gelatin at 1.270.

Layer 5 (Interlayer): ILS-1 at 0.075; ADD-9 at 0.002; and gelatin at 0.700.

Layer 6 (Slow magenta layer): a blend of two green sensitized (both with a mixture of GSD-1 and GSD-2) silver iodobromide emulsions: (i) 1.0×0.08 micron, 4.1 mole % iodide at 0.0.237 and (ii) 0.55×0.08, 1.5 mole % iodide at 0.431; magenta dye forming coupler M-1 at 0.299; MC-2 at 0.041; ADD-6 at 1.8 g/mol silver; ADD-1 at 64 mg/mol silver; OxDS-1 at 2.8 g/mole silver; and gelatin at 1.27.

Layer 7 (Mid magenta layer): a green sensitized (same as above) tabular silver iodobromide emulsion 1.2×0.12, 4.1 mole % 1 at 1.00; M-1 at 0.82; MC-2 at 0.032; DIR-8 at 0.024; OxDS-1 at 0.045; ADD-6 at 1.8 g/mol silver; ADD-7 at 0.05 mg/mol silver; and gelatin at 1.465.

Layer 8 (Fast magenta layer): a green sensitized tabular silver iodobromide (2.2×0.13, 4.1 mole % I) emulsion at 1.044; M-1 at 0.057; MC-2 at 0.043; DIR-2 at 0.011; DIR-7 at 0.011; OxDS-1 at 0.031; ADD-6 at 1.8 g/mol silver; ADD-7 at 0.1 mg/mol silver and gelatin at 1.251.

Layer 9 (Yellow filter layer): yellow filter dye YFD-1 at 0.161; ILS-1 at 0.075; ADD-9 at 0.002; and gelatin at 0.648.

Layer 10 (Experimental layer): Experimental emulsions tabular silver emulsion 1; yellow dye forming coupler Y-1 at 1.044; DIR-3 at 0.076; B-1 at 0.022; ADD-6 at 1.8 g/mol silver and gelatin at 1.879.

Layer 11 (UV filter layer): silver bromide Lippman emulsion at 0.216; UV-1 at a total of 0.108; gelatin at 1.242 and bis(vinylsulfonyl)methane hardener at 1.75% of total gelatin weight.

Layer 12 (Protective Overcoat) Matte beads; gelatin at 0.888

Surfactants, coating aids, emulsion addenda, sequestrants, thickeners, lubricants, matte and tinting dyes were added to the appropriate layers as is common in the art. Structures of the materials used in this multilayer format are as follows:

DYE-1:
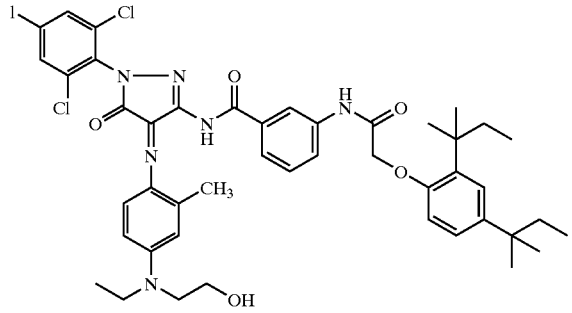
DYE-5
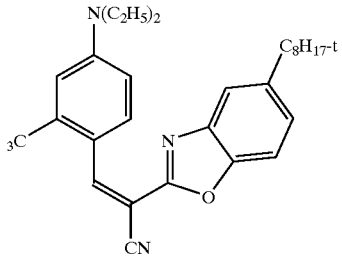
DYE-6
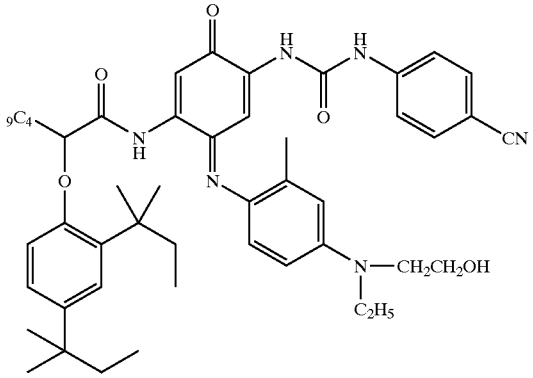
UV-1:
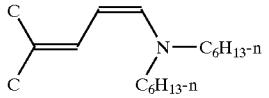
UV-2:
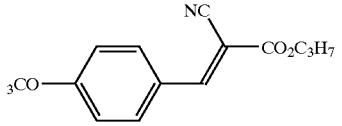
-continued
C-1:
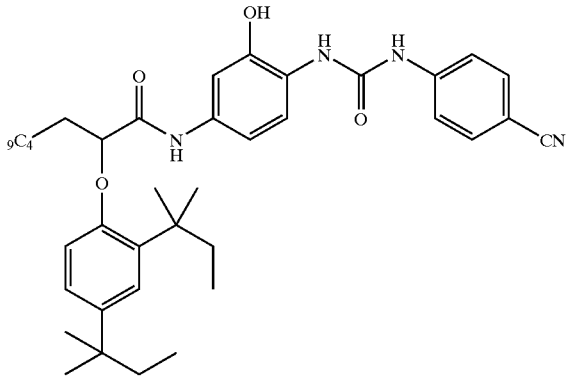
M-1:
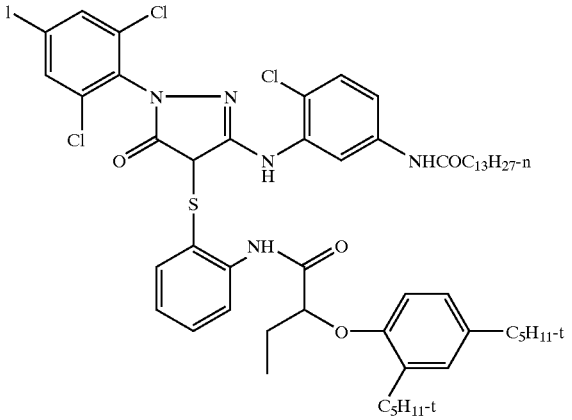
Y-1:
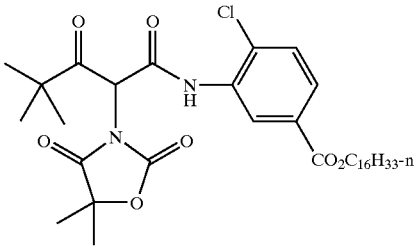
B-1:
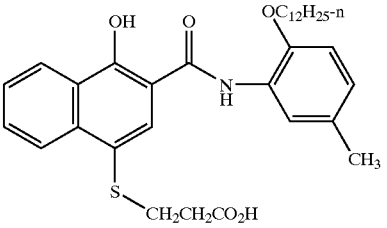

-continued
MC-1:
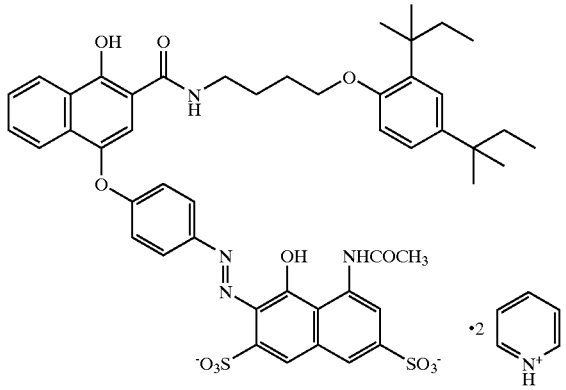
MC-2:
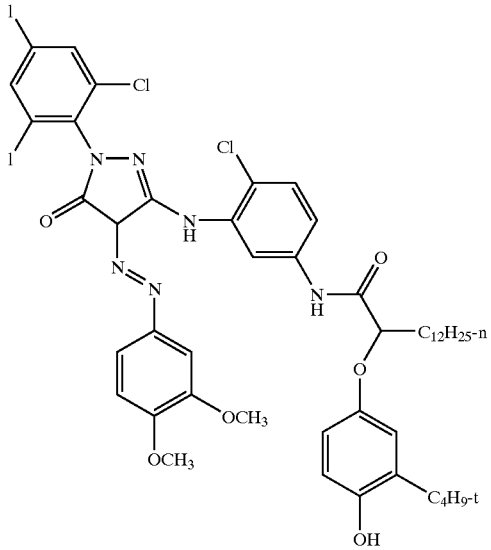
DIR-1:
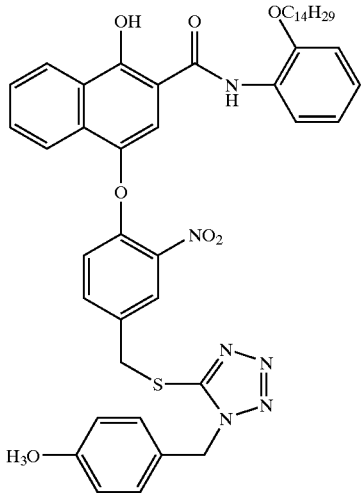
-continued
DIR-2:
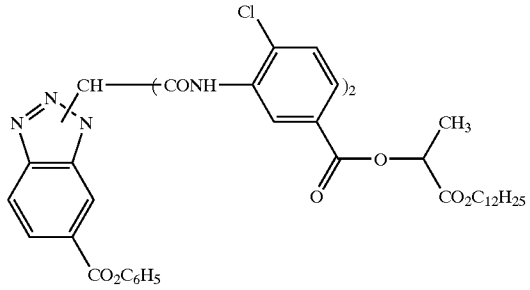
DIR-3:
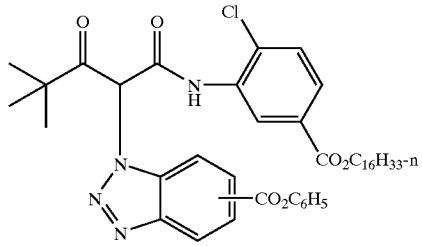
DIR-7:
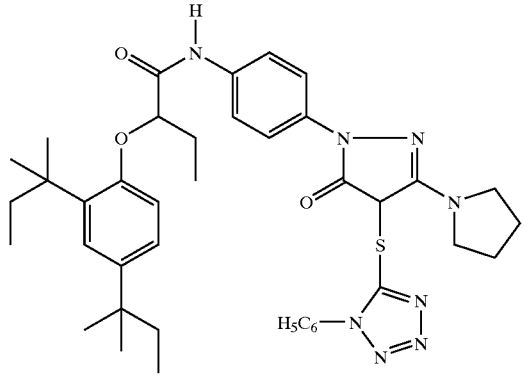
DIR-8
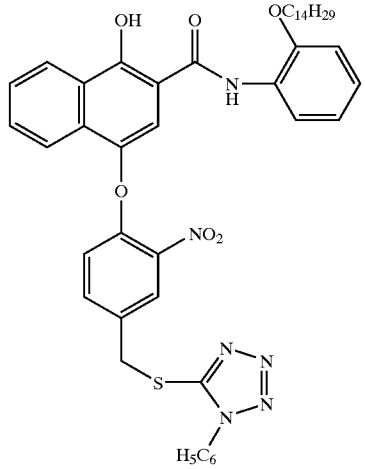
ILS-1:
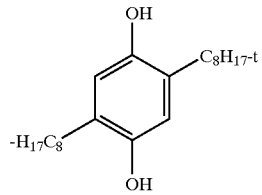

-continued

OxDS-1:

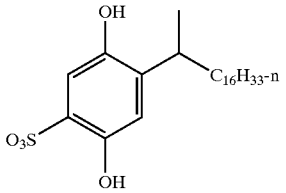

YFD-1:

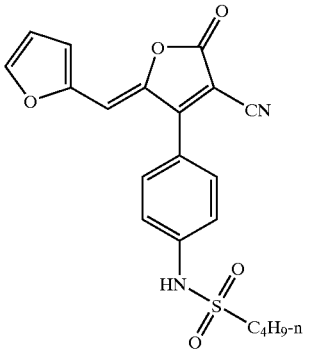

RSD-1:

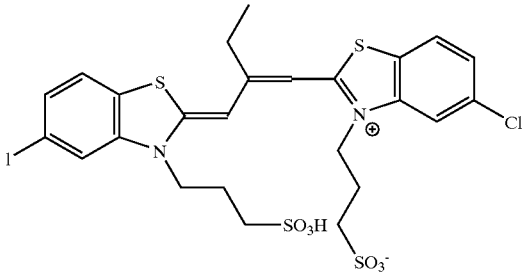

RSD-2:

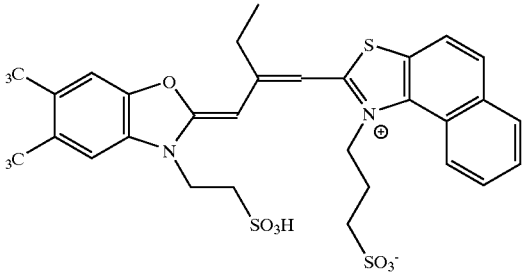

GSD-1:

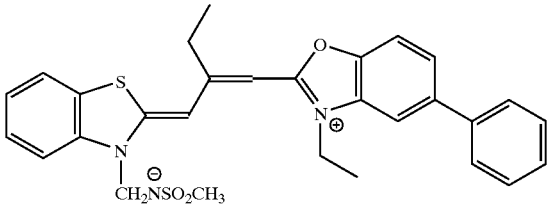

-continued

GSD-2:

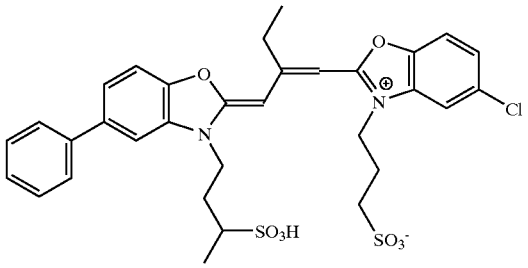

BSD-1:

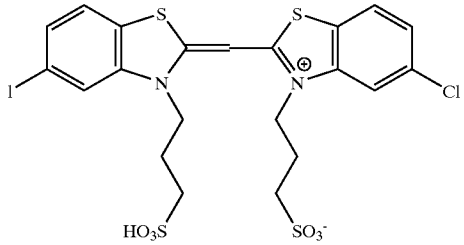

ADD-1

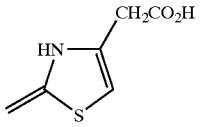

ADD-2

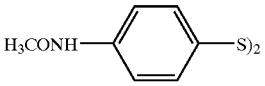

| | |
|---|---|
| ADD-3 | Sodium Hexametaphosphate |
| ADD-6 | 4-Hydroxy-6-methyl-1, 3, 3a, 7-tetrazaindene |
| ADD-7 | $Au_2S$ |
| ADD-9 | $PdCl_2$ |

ML example 2=like ML example 1 but with 1.9 umoles FED-2/mole Ag added to experimental layer.

ML ex. 3=like ML example 1 coated on PEN (3.4 mil thickness of glow discharge treated polyethylene-2,6-napthalene support).

ML ex 4=like ML example 2 coated on PEN (3.4 mil thickness of glow discharge treated polyethylene-2,6-napthalene support).

ML ex. 5 through 8=like ML ex. 1 through 4 except emulsion 2 was used in place of emulsion 1.

ML ex. 9 through 12=like ML ex. 1 through 4 except emulsion 3 was used in place of emulsion 1.

Samples of each element were conditioned to 50% RH at 25° C. These samples were packaged in air and light tight envelopes. These samples were then placed in temperature controlled chambers. One chamber was held at 49° C. and the checks were held at −18° C.

Samples of each element were removed from said chambers after four weeks and given a stepped exposure and processed in the KODAK FLEXICOLOR (C-41) process as described in *British Journal of Photography Annual*, 1988, pp 196–198. The following Table 1 compares the relative sensitivity to light before thermal treatment and the fog (Dmin) growth resulting from the thermal treatment. The portion of this fog growth that could be attributed to the presence of the FED compound was also calculated (i.e. by comparing the fog growth for example 2 to that for example 1).

The relative sensitivity was determined from the characteristic curve and was evaluated at the exposure required to produce a density 0.15 above fog. Sensitivity of each sample is shown relative to the sensitivity of Emulsion 1 in ML example 1, set equal to 100. In this approach a higher number means higher sensitivity (higher speed). is the density measured at the area of no exposure (ie minimum density).

TABLE 1

Multilayer data on acetate or PEN support

| ML Example | Feature | Rel. Sens. | Dmin* | Delta Dmin 4 wk 49 C vs. check | Added Dmin attributed to FED |
|---|---|---|---|---|---|
| 1 | Emul 1 on acetate | 100 | 0.85 | 0.07 | — |
| 2 | Emul 1 + FED-2 on acetate | 150 | 0.87 | 0.17 | 0.10 |
| 3 | Emul 1 on PEN | 98 | 0.87 | 0.09 | — |
| 4 | Emul 1 + FED-2 on PEN | 145 | 0.89 | 0.12 | 0.03 |
| 5 | Emul 2 on acetate | 112 | 0.81 | 0.04 | — |
| 6 | Emul 2 + FED-2 on acetate | 195 | 0.82 | 0.12 | 0.08 |
| 7 | Emul 2 on PEN | 112 | 0.81 | 0.06 | — |
| 8 | Emul 2 + FED-2 on PEN | 191 | 0.82 | 0.07 | 0.01 |
| 9 | Emul 3 on acetate | 115 | 0.89 | 0.07 | — |
| 10 | Emul 3 + FED-2 on acetate | 141 | 0.89 | 0.25 | 0.18 |
| 11 | Emul 3 on PEN | 110 | 0.91 | 0.15 | — |
| 12 | Emul 3 + FED-2 on PEN | 138 | 0.91 | 0.16 | 0.01 |

*corrected for base tint

Table 1 demonstrates that there is a speed advantage when the FED agent is added and this speed advantage is not influenced by support choice. It also demonstrates that there is an attendant increase in incubation Dmin growth that is influenced by support choice. The Dmin increase is lessened when the emulsions plus FED agent are coated on PEN. This was true for all three emulsion varieties and as can be seen in the last column of Table 1, the Dmin increase attributable to FED agents is always dramatically lowered on PEN.

Several more examples were prepared to determine if the advantage could also be found with related FED agents and related support materials using a single layer (SL) format for ease of experimentation (coverages are in grams per meter squared unless otherwise stated). These examples were prepared as follows:

SL example 1

Support=cellulose triacetate, thickness 4.9 mil

Layer 1 (Experimental layer): Experimental tabular silver halide emulsion 4 at 1.08; cyan dye forming coupler C-1 at 0.807; ADD-6 at 1.8 g/mol silver; and gelatin at 1.879.

Layer 2 (UV filter layer and protective overcoat): UV-1 at a total of 0.108; Matte beads; gelatin at 1.242 and bis (vinylsulfonyl)methane hardener at 1.75% of total gelatin weight.

Surfactants, coating aids, were added to the appropriate layers as is common in the art.

SL example 2=SL ex 1 except 1.9 micromoles FED-2/Ag mol added to layer 1 prior to coating SL example 3=SL ex 1 except 1.9 micromoles FED-1

SL example 4=SL ex 1 except 1.9 micromoles FED-6

SL examples 5 to 8 are equivalent to 1 to 4 except coated on on PEN (3.4 mil thickness of glow discharge treated polyethylene-2,6-napthalene support)

SL examples 9 to 12 are equivalent to 1 to 4 except coated on PET (3.9 mil thickness of polyethylene terephthalate support, Kodak Estar® support)

Samples of each element were conditioned to 50% RH at 25° C. These samples were packaged in air and light tight envelopes. These samples were then placed in temperature controlled chambers. One chamber was held at 49° C. and the checks were at −18° C.

Samples of each element were removed from said chambers after one week and were exposed and processed as the multilayer samples described above.

A relative sensitivity was determined as described above. Sensitivity of each sample is shown relative to the sensitivity of Emulsion 4 in single layer example 1, set equal to 100. Table B below compares speeds and Dmin of the frozen checks and change in Dmin density with higher temperature incubations for all twelve examples.

TABLE 2

Single layer data on acetate, PEN, or PET support

| SL Example | Feature | Rel. Sens. | Dmin* | Delta Dmin 4 wk 49 C vs. check | Added Dmin attributed to FED |
|---|---|---|---|---|---|
| 1 | No FED, acetate | 100 | 0.18 | 0.02 | — |
| 2 | FED-2, acetate | 126 | 0.27 | 0.17 | 0.15 |
| 3 | FED-1, acetate | 123 | 0.21 | 0.08 | 0.06 |
| 4 | FED-6, acetate | 123 | 0.30 | 0.08 | 0.06 |
| 5 | No FED, PEN | 100 | 0.24 | 0.02 | — |
| 6 | FED-2, PEN | 123 | 0.31 | 0.06 | 0.04 |
| 7 | FED-1, PEN | 118 | 0.25 | 0.03 | 0.01 |
| 8 | FED-6, PEN | 107 | 0.33 | 0.06 | 0.04 |
| 9 | No FED, PET | 126 | 0.20 | 0.01 | — |
| 10 | FED-2, PET | 155 | 0.29 | 0.04 | 0.03 |
| 11 | FED-1, PET | 151 | 0.23 | 0.01 | 0 |
| 12 | FED-6, PET | 138 | 0.33 | 0.04 | 0.03 |

The last column in Table 2 clearly demonstrates that the advantage of lower increases in incubation Dmin can be gained with other FED compounds when coated on PEN support. This column also shows that a similar advantage can be obtained by coating on PET support.

The invention has been described in detail with particular reference to certain preferred embodiments thereof, but it will be understood that variations and modifications can be effected within the spirit and scope of the invention.

What is claimed is:

1. A silver halide photographic element comprising a transparent support with low oxygen permeability and further comprising a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler wherein at least one silver halide emulsion layer contains a fragmentable electron donating compound of the formula: X—Y' or a compound which contains a moiety of the formula —X—Y', wherein:

X is an electron donor moiety, Y' is a leaving proton H or a leaving group Y, with the proviso that if Y' is a proton, a base, $\beta^-$, is present in the emulsion layer, and wherein:

1) X—Y' has an oxidation potential between 0 and about 1.4 V; and 2) the oxidized form of X—Y' undergoes a bond cleavage reaction to give the radical $X^{\bullet}$ and the leaving fragment Y';

and, optionally, 3) the radical $X^{\bullet}$ has an oxidation potential $\leqq -0.7$V (that is, equal to or more negative than about −0.7V).

2. A photographic element according to claim 1, wherein the support has an oxygen permeability equal to or less that 100 cc/$m^2$/day.

3. A photographic element according to claim 1, wherein the support has an oxygen permeability equal to or less than 50 cc/$m^2$/day.

4. A photographic element according to claim 1, wherein the support comprises a polyester.

5. A photographic element according to claim 1, wherein the support comprises polyethylene terephthalate or polyethylene naphthalate.

6. A photographic element according to claim 1, wherein the support comprises polyethylene-2,6-naphthalate.

7. A photographic element according to claim 1, wherein X is of structure (I):

(I)

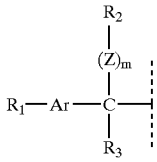

$R_1$=R, carboxyl, amide, sulfonamide, halogen, $NR_2$, $(OH)_n$, $(OR')_n$, or $(SR)_n$;

R'=alkyl or substituted alkyl;

n=1–3;

$R_2$=R, or Ar';

$R_3$=R, or Ar';

$R_2$ and $R_3$ together can form a 5- to 8-membered ring wherein:

m=0, 1;

Z=O, S, Se, or Te;

$R_2$ and Ar=can be linked to form a 5- to 8-membered ring;

$R_3$ and Ar=can be linked to form a 5- to 8-membered ring;

Ar'=aryl group or heterocyclic group.

and

R=a hydrogen atom or an unsubstituted or substituted alkyl group.

8. A photographic element according to claim 7, wherein the compound of Structure (I) is selected from:

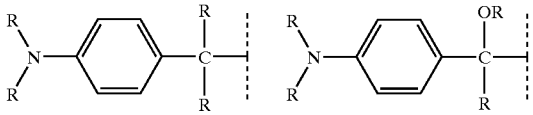

-continued

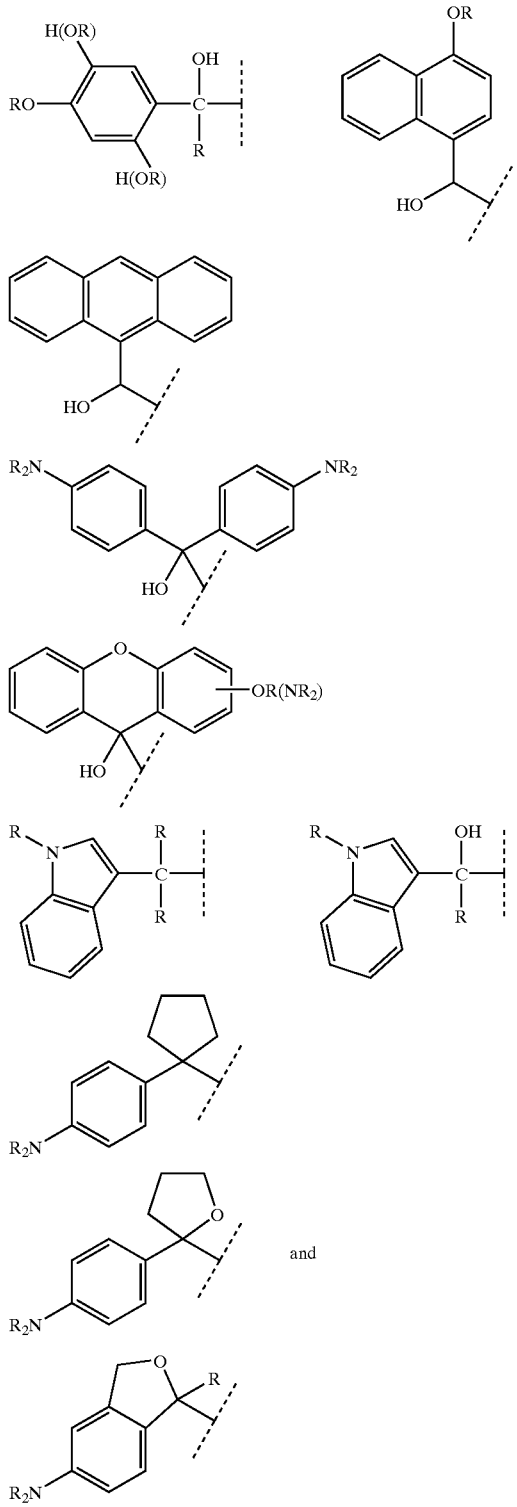

wherein each R is independently a hydrogen atom or a substituted or unsubstituted alkyl group.

9. A photographic element according to claim 1, wherein X is a compound of structure (II):

(II)

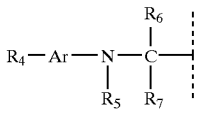

wherein:

Ar=aryl group or heterocyclic group $R_4$=a substituent having a Hammett sigma value of −1 to +1, $R_5$=R or Ar'

$R_6$ and $R_7$=R or Ar'

$R_5$ and Ar=can be linked to form a 5- to 8-membered ring;

$R_6$ and Ar=can be linked to form a 5- to 8-membered ring (in which case, $R_6$ can be a hetero atom);

$R_5$ and $R_6$ can be linked to form a 5- to 8-membered ring;

$R_6$ and $R_7$ can be linked to form a 5- to 8-membered ring,

Ar'=aryl group or heterocyclic group; and

R=hydrogen atom or an unsubstituted or substituted alkyl group.

10. A photographic element according to claim 9, wherein X is selected from:

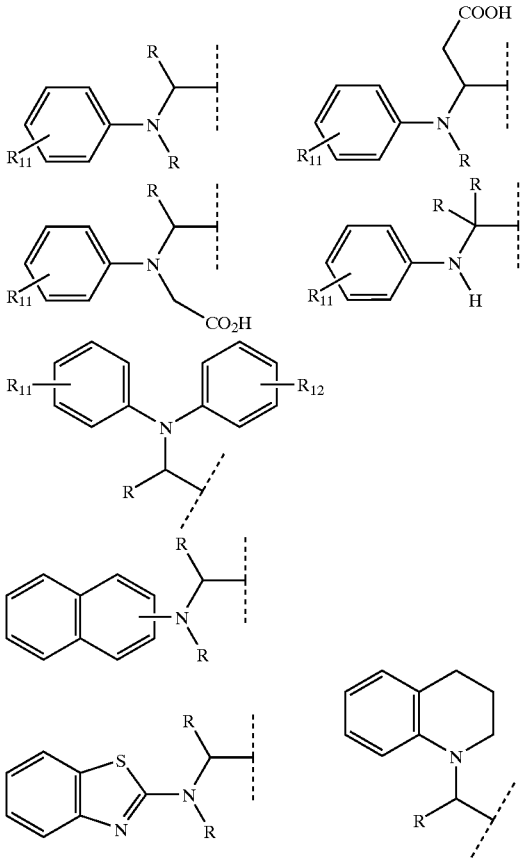

-continued

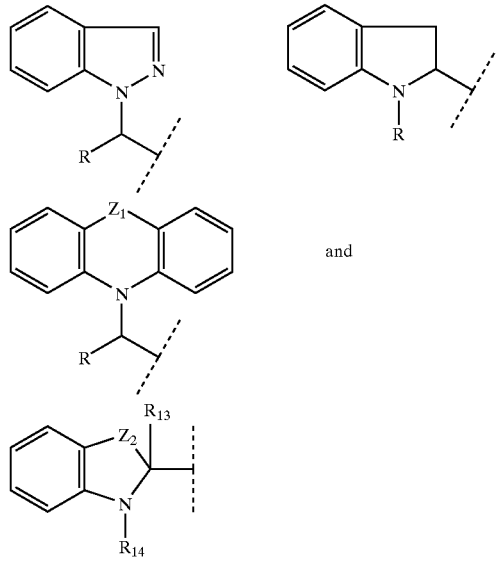

and $R_{11}$ and $R_{12}$ = { H, alkyl, alkoxy, alkylthio, halo, carbamoyl; carboxyl, amido, formyl, sulfonyl, sulfonamido, nitrile } or R is a hydrogen atom or an unsubstituted or substituted alkyl group; $Z_1$=a covalent bond, S, O, Se, NR, $CR_2$, CR═CR, or $CH_2CH_2$;

$Z_2$=S, O, Se, NR, $CR_2$, or CR═CR, $R_{13}$,=alkyl, substituted alkyl or aryl, and $R_{14}$=H, alkyl substituted alkyl or aryl.

11. A photographic element according to claim 1, wherein X is a compound of structure (III):

(III)

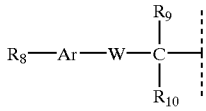

wherein:

W=O, S, or Se;

Ar=aryl group or heterocyclic group;

$R_8$=R, carboxyl, $NR_2$, $(OR)_n$, or $(SR)_n$ (n=1–3);

$R_9$ and $R_{10}$=R, or Ar';

$R_9$ and Ar=can be linked to form a 5- to 8-membered ring,

Ar'=aryl group or heterocyclic group; and

R=a hydrogen atom or an unsubstituted or substituted alkyl group.

12. A photographic element according to claim 11, wherein X is selected from:

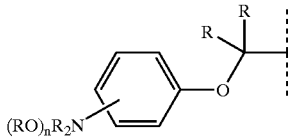

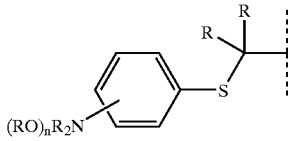

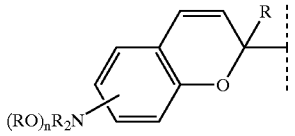

and

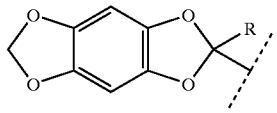

n = 1–3.

13. A photographic element according to claim 1, wherein X is of structure (IV):

(IV)

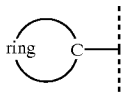

wherein:

"ring" represents a substituted or unsubstituted 5-, 6- or 7-membered unsaturated ring.

14. A photographic element according to claim 13, wherein X is selected from:

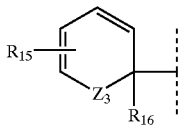

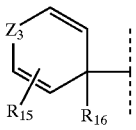

and

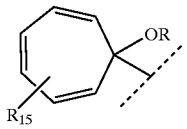

R is a hydrogen atom or an unsubstituted or substituted alkyl group; $Z_3$=O, S, Se, or NR $R_{15}$=R, OR, or $NR_2$ $R_{16}$=alkyl or substituted alkyl.

15. A photographic element according to claim 1, wherein Y' is:

(1) X', where X' is an X group as defined in structures I–IV and may be the same as or different from the X group to which it is attached (2)

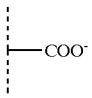

-continued (3)

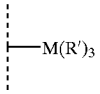

where M = Si, Sn or Ge; and R′ = alkyl or substituted alkyl (4)

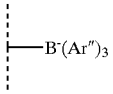

where Ar″ = aryl or substituted aryl or (5)

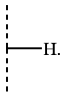

16. A photographic element according to claim 1, wherein the fragmentable electron donor compound is selected from compounds of the formulae:

$Z—(L—X—Y')_k$ $A—(L—X—Y')_k$ $(A—L)_k—X—Y'$ $Q—X—Y'$ $A—(X—Y')_k$ $(A)_k—X—Y'$ $Z—(X—Y')_k$ or $(Z)_k—X—Y'$ wherein:

Z is a light absorbing group;

k is 1 or 2;

A is a silver halide adsorptive group;

L represents a linking group containing at least one C, N, S, P or O atom; and

Q represents the atoms necessary to form a chromophore comprising an amidinium-ion, a carboxyl-ion or dipolar-amidic chromophoric system when conjugated with X—Y'.

17. A photographic element according to claim 16, wherein the fragmentable electron donor compound is of the formula:

$Z—(L—X—Y')_k$ $Z—(X—Y')_k$ or $(Z)_k—X—Y'$ wherein Z is derived from a cyanine dye, complex cyanine dye, merocyanine dye, complex merocyanine dye, homopolar cyanine dye, styryl dye, oxonol dye, hemioxonol dye, or hemicyanine dye.

18. A photographic element according to claim 16, wherein the fragmentable electron donor compound is of the formula:

$A—(L—X—Y')_k$ $(A—L)_k—X—Y'$ $A—(X—Y')_k$ or $(A)_k—X—Y'$ wherein: A is a silver-ion ligand moiety or a cationic surfactant moiety.

19. A photographic element according to claim 18, wherein A is selected from the group consisting of: i) sulfur acids and their Se and Te analogs, ii) nitrogen acids, iii) thioethers and their Se and Te analogs, iv) phosphines, v) thionamides, selenamides, and telluramides, and vi) carbon acids.

20. A photographic element according to claim 16, wherein the fragmentable electron donor compound is of the formula:

$Q—X—Y'$ wherein Q represents a chromophoric system comprising a cyanine, complex cyanine, hemicyanine, merocyanine, or complex merocyanine dye.

* * * * *